US006933847B2

(12) United States Patent
Feibelman

(10) Patent No.: US 6,933,847 B2
(45) Date of Patent: Aug. 23, 2005

(54) ANTI-THEFT TAG

(75) Inventor: Jeffrey A. Feibelman, Providence, RI (US)

(73) Assignee: A&H Manufacturing, Co., Johnston, RI (US)

( * ) Notice: Subject to any disclaimer, the term of this patent is extended or adjusted under 35 U.S.C. 154(b) by 44 days.

(21) Appl. No.: 10/696,483

(22) Filed: Oct. 29, 2003

(65) Prior Publication Data

US 2005/0116827 A1 Jun. 2, 2005

(51) Int. Cl.[7] ..... G08B 13/14

(52) U.S. Cl. ..... 340/572.1; 340/568.1; 340/572.9; 24/3.1; 24/3.13; 70/57.1; 70/58

(58) Field of Search ..... 340/568.1, 571, 340/572.1, 572.9; 24/3.1, 3.5, 3.7, 3.13; 70/57.1, 58

(56) References Cited

U.S. PATENT DOCUMENTS

| | | | | |
|---|---|---|---|---|
| 3,065,946 | A | 11/1962 | Berkow | |
| 3,253,270 | A | 5/1966 | Downer | |
| 3,911,534 | A | 10/1975 | Martens et al. | |
| 3,961,431 | A | 6/1976 | Kalenian | |
| 4,506,415 | A | 3/1985 | Swift | |
| 4,746,909 | A | 5/1988 | Israel et al. | |
| 4,875,647 | A | 10/1989 | Takagi et al. | 248/74.3 |
| 5,079,540 | A | 1/1992 | Narlow et al. | |
| 5,099,228 | A | 3/1992 | Israel et al. | |
| 5,120,097 | A | 6/1992 | Fattori et al. | 292/318 |
| 5,293,668 | A | 3/1994 | Tibiletti | |
| 5,337,503 | A | 8/1994 | Goby et al. | 40/665 |
| 5,421,177 | A | 6/1995 | Sieber et al. | |
| 5,437,172 | A | 8/1995 | Lamy et al. | |
| 5,513,421 | A | 5/1996 | Wells | |
| 5,524,463 | A | 6/1996 | Schenkel et al. | |
| 5,570,080 | A | 10/1996 | Inoue et al. | |

(Continued)

FOREIGN PATENT DOCUMENTS

| | | |
|---|---|---|
| FR | 2 713 379 | 6/1995 |

*Primary Examiner*—Julie Bichngoc Lieu
(74) *Attorney, Agent, or Firm*—Bowditch & Dewey, LLP

(57) ABSTRACT

An anti-theft security tag includes an engagement member having a first and second end securable within a housing for attachment to an article. The housing supports an electronic article surveillance marker and may include one or more channels for receiving and securing at least one crimping sleeve. The at least one crimping sleeve is sized to receive one end of the engagement member. A slot is disposed within the housing in alignment with the at least one crimping sleeve, and is sized to receive a crimping tool to crimp the sleeve and secure the wire to the article within the housing.

20 Claims, 13 Drawing Sheets

U.S. PATENT DOCUMENTS 5,689,237 A 11/1997 Sasagawa et al.
5,717,382 A 2/1998 Cooper
5,754,108 A * 5/1998 Ungarsohn ..... 340/568.1
5,883,576 A 3/1999 De La Huerga
5,945,909 A 8/1999 Kolton
5,949,336 A 9/1999 Deschenes et al.
5,969,613 A 10/1999 Yeager et al.
5,977,877 A 11/1999 McCulloch et al.
6,052,876 A 4/2000 Hogan et al.
6,064,306 A 5/2000 Deschenes et al.
6,128,932 A 10/2000 Mainetti et al.
6,188,320 B1 2/2001 Kolton et al.
6,226,839 B1 5/2001 Sayegh
6,255,950 B1 7/2001 Nguyen
6,308,539 B1 10/2001 Kolton et al.
6,311,531 B1 * 11/2001 Sykes ..... 70/57.1
6,326,890 B1 12/2001 Costa
6,343,819 B1 2/2002 Shiozaki ..... 292/307 R
6,373,390 B1 4/2002 Hogan et al.
6,389,853 B1 5/2002 Pate et al.
6,433,686 B1 8/2002 Feibelman
6,446,474 B1 * 9/2002 Tabacchi et al. ..... 70/16
6,476,717 B1 11/2002 Gross et al.
6,535,130 B2 3/2003 Nguyen et al.
6,567,003 B2 5/2003 Kolton et al.
6,578,394 B2 * 6/2003 Yin ..... 70/58
6,624,753 B2 9/2003 Elston
2002/0154014 A1 10/2002 Elston
2002/0158762 A1 10/2002 Nguyen et al.
2003/0020613 A1 1/2003 Cosnard
2003/0160697 A1 8/2003 Sedon et al.
2004/0074265 A1 * 4/2004 Bruening et al. ..... 70/59

* cited by examiner

ANTI-THEFT TAG

TECHNICAL FIELD

The invention relates generally to an anti-theft tags and, more specifically to an improved anti-theft tag including an electronic article sensor for attaching to a product, such as a watch.

BACKGROUND OF RELATED ART

It is well known in the art to use electronic article surveillance (EAS) sensors in order to prevent the theft of consumer products. Such electronic sensors trigger an alarm if not detached or disarmed before the product is removed from the store. For many products, electronic sensors have been very effective in deterring theft. However, such sensors can be difficult to attach to certain products, for example jewelry, and can often be easily removed from such items even when attached. One higher price item where the difficulty of attaching electronic sensors is prevalent is watches. Often sensors cannot be attached to watch bands because they can be easily slipped off one end, and if the sensors are overly large they can limit the customer's ability to try on the watch before purchasing. Thus, electronic sensors attached to products such as watches must not only be tamper resistant in the hands of the consumer, but should also not interfere with the consumer's ability to try on the product. In addition, it is desirable to have sensors which can be readily attached to a variety of products, which can be attached in a convenient manner, and which are tamper resistant so that the EAS sensor cannot be readily removed by the consumer. A variety of tags containing EAS sensors have been developed over the past years in an attempt to address these and other concerns.

One such sensor is described in U.S. Pat. No. 6,188,320 to Kolton et al. The '320 patent discloses an article identification and surveillance tag having an article engaging loop (22) which is adjustable by pulling on end member **(20*b*) which is accessible exteriorly of the tag body. The tag (10) includes a body formed of housings (12 and 14) which are joined together during use. A tail (20) includes a first tail end (20*a*) which is peripherally continuous with a first end of the housing (12) which defines loop (22) exteriorly of the housing. The tail (20) extends from the loop, into and through the housing and terminates in tail end piece (20*b*), which is accessible exteriorly of the tag (10). Housing (12) defines and interior channel (24), the walls of which are formed with facing ratchets (26 and 28). Secured to tail (20) interiorly of housing (12) is a collar (30) of pawl member (32). The outer walls of pawl member (32) are formed with teeth (34 and 36) which engage respectively with ratchets (26 and 28). The ratchets 26 and 28) and teeth (34 and 36), engage such that the pawl member (32) is moveable only in one direction, i.e., downwardly, so that the loop can only be made smaller. The ratchets and teeth thus from a one way clutch, which precludes upward movement of pawl member (32). In one embodiment, the tail (52) defines a loop (53) exteriorly of the housing, the tail extending from the loop and tail parts (52*a*, 52*b*), ends of which are joined inside member (52*c*), and which is accessible exteriorly of tag (42)**.

U.S. Pat. No. 6,128,932 to Mainetti et al. discloses an anti-shoplifting device including a housing having a lower half (2) and an upper half (3), and a ferromagnetic plate (4) which is inserted into an internal cavity (5) formed by the upper and lower halves after they have been joined. A flexible and/or elastic cord (8) is supported on an edge of the lower half (2) and includes a spike (9) having flexible tongues (10), the spike (9) being insertable in an irreversible manner into opening (7) of the lower half (2) in order to for a loop which is attachable to a product.

U.S. Pat. No. 5,437,172 to Lamy et. al. discloses an anti-theft device for eyeglasses including a plate (1) having a link (7) extending therefrom. The plate includes a slot (14) for inserting the free end portion (15) of the link (7) and has fastening means for retaining the end portion (15). The fastening means includes a block (16) supported on the plate (1). The link (7) is connected to the plate (1) by inserting the link into a slot (18) until a bulged portion (17) is in abutment. After the link (7) has been looped around the bridge of the frame of a pair of eyeglasses, it is then inserted into the slot (14) to be locked therein. The link is fastened by a pin (22) which is moveable perpendicularly to the link and which projects into one of the holes (10) of the link under the action of a spring (23).

While generally effective, the aforementioned devices and others available in the art can still be difficult to attach to a variety of products, and can often be tampered with by the consumer. Accordingly, there is continued development in the art in order to further improve anti-theft tags.

SUMMARY

One object of the present invention is to provide an anti-theft security tag including an electronic article surveillance marker which is capable of being readily assembled, while being tamper resistant after assembly.

In accordance with one aspect, there is provided an anti-theft security tag having an engagement member, for example a cable or wire, which includes a first and a second end securable within a housing for attachment to an article, for example a watch band. The housing preferably further includes a channel for receiving and securing a crimping sleeve, and supports an electronic article surveillance marker. A slot is preferably disposed within the housing for receiving a crimping tool in order to attach and secure the wire to the article, and within the housing, so that the ends of the wire are not readily accessible by a consumer. The combination of these features allows the anti-theft tag to be readily assembled and tamper resistant after assembly, as described in greater detail below.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENT

Figure 1:
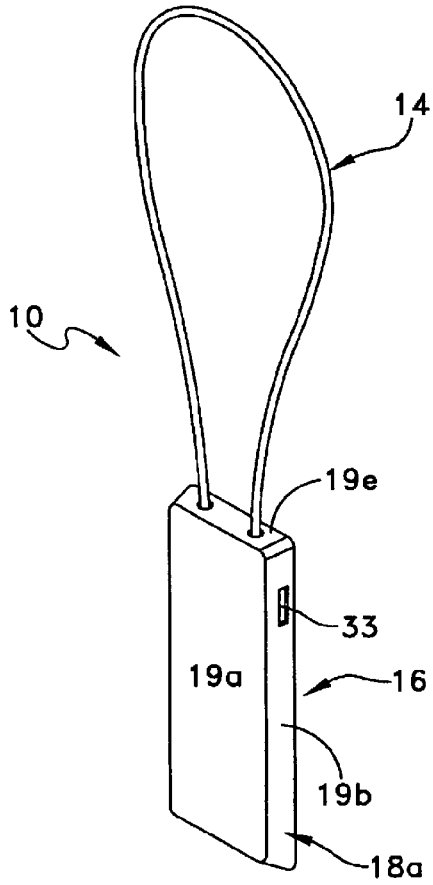
FIG. 1 is a front perspective view of an anti-theft tag in accordance with a first embodiment.
Figure 2:
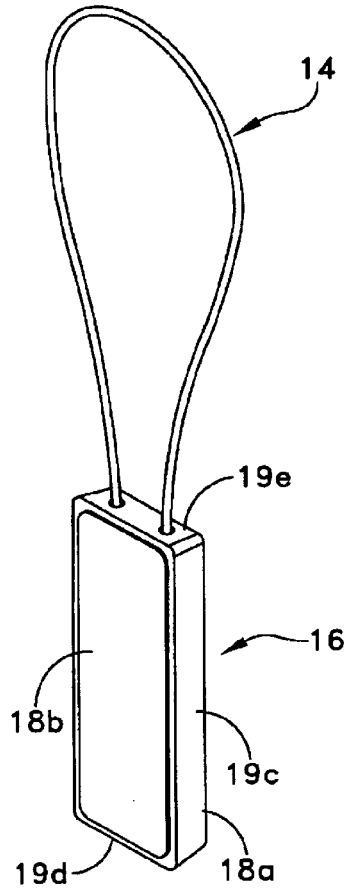
FIG. 2 is a rear perspective view of the anti-theft tag of FIG. 1.
Figure 3:
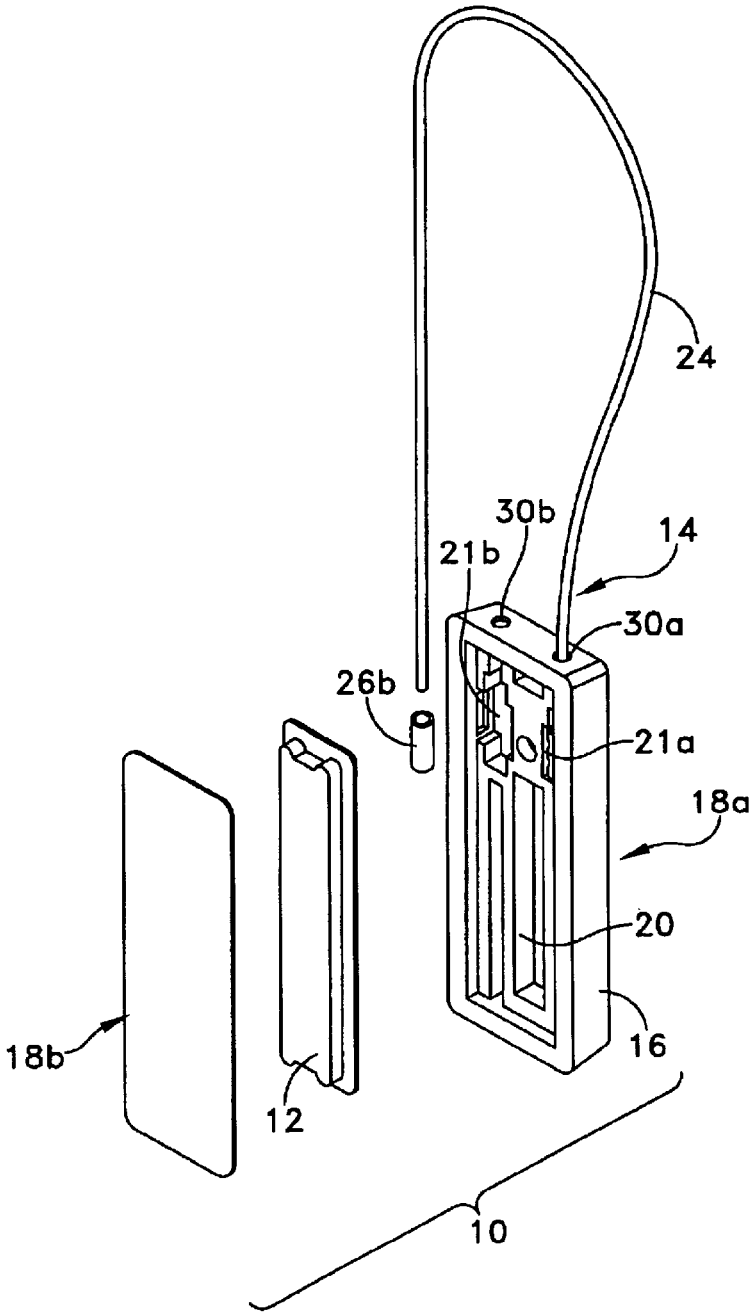
FIG. 3 is an exploded view of the anti-theft tag of FIG. 1.
Figure 4:
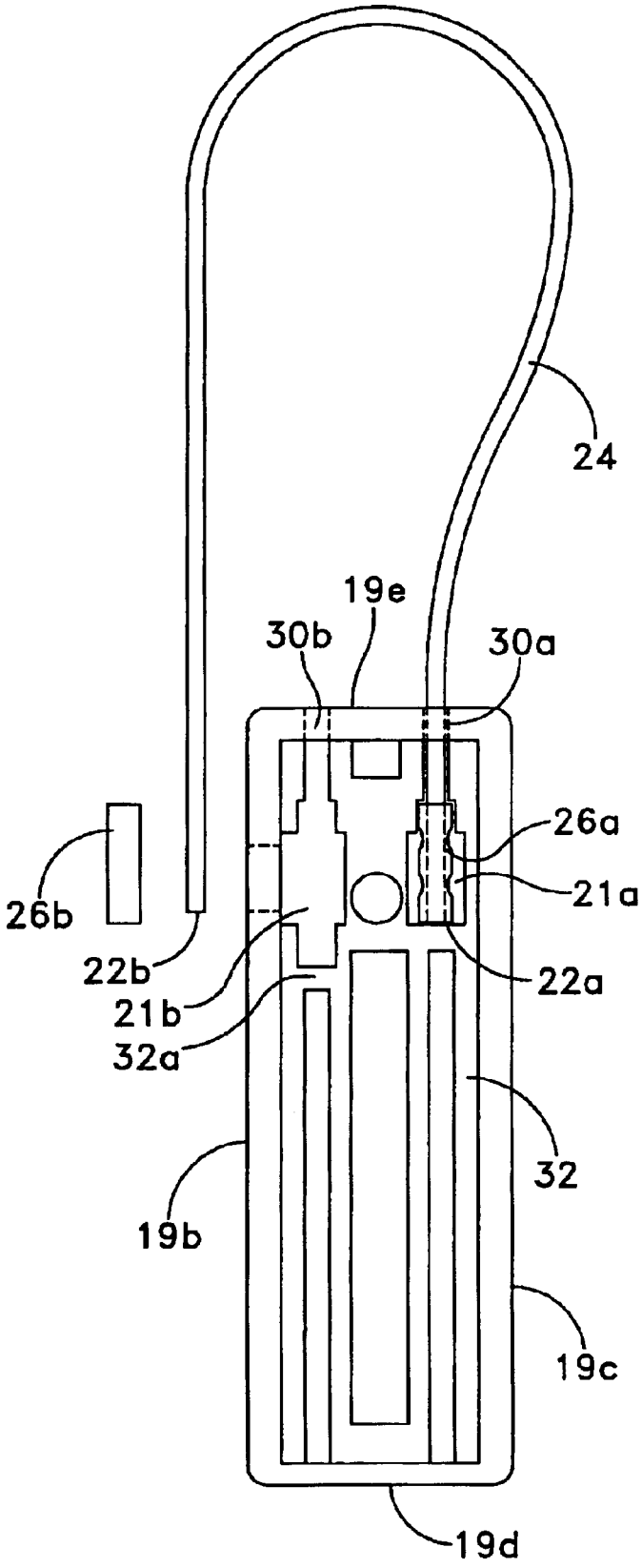
FIG. 4 is a top plan view of the anti-theft tag of FIG. 1 with the backing removed.

An anti-theft security tag 10 including an electronic article surveillance marker 12 for attachment to an article, such as a watch band 13, is illustrated in FIGS. 1–15. As used herein, the term "article" refers to any type or style of consumer product. Also, as used herein, "watch" refers to any style or type of watch which may be worn by a user. However, it is expressly understood that the present invention is not limited to use with watches and may be used with any of a variety of articles as would be known to those of skill in the art.

Referring now to the FIGS. 1–9, a first embodiment of the anti-theft security tag 10 is illustrated. The tag 10 includes an engagement member 14 for securing the tag to an article, such as a watch, and a housing 16 for supporting an electronic article surveillance (EAS) marker 12. In the present embodiment, the housing 16 preferably includes a base 18*a* and a backing member 18*b*. The base preferably includes a front wall 19*a*, side walls 19*b* and 19*c*, a bottom wall 19*d* and a top wall 19*e*, the walls bounding a cavity 20 formed in the base. In the present embodiment, the top wall 19*e* includes a pair of holes sized to receive a first end and a second end 22*a*, 22*b*, respectively, of the engagement member 14, the holes providing access to a pair of channels 21*a*, 21*b* disposed within the base. The engagement member 14 may take any of a variety of forms, suitable for engagement with an article, and preferably includes a wire 24 and a pair of crimping sleeves 26*a*, 26*b* for retaining the first and second ends of the wire within the housing during use, as described in greater detail below. The wire is preferably sufficiently strong so as to withstand tampering. In the present embodiment, the wire is able to withstand about 40 to about 50 lbs of pressure before beginning to fail.

The crimping sleeves 26*a*, 26*b* are preferably cylindrical and are sized to loosely fit around the first and second ends 22*a*, 22*b* of the engagement member prior to crimping, and are also sized to fit within the channels 21*a*, 21*b*. The crimping sleeves are pliant so that a crimping tool 28 engaging the sleeves will force the sleeves inward so as to crimp around the ends of the engagement member, as is known in the art. The first end 22*a* of the engagement member 14 is preferably received through an opening 30*a* in the top wall 18*e* of the base 18*a* and into the crimping sleeve 26*a* disposed in channel 21*a*. The crimping sleeve 26*a* is preferably crimped by the manufacturer, and is sized larger than the opening 30*a* so that the first end is secured within the base 18*a* when received by a retail establishment. Although a channel is provided for the crimping sleeve 26*a*, it is an optional feature and may be eliminated as would be known to one of skill in the art. The second end 22*b* of the wire 24 is preferably not crimped at this point so that the tag can be attached to the article at a later date. However, crimping sleeve 26*b* is preferably held in place within channel 21*b*, in alignment with opening 30*b* and slot 33, which is sized to receive a crimping tool, as described in greater detail below.

A conventional EAS marker 12 is preferably placed over the crimping sleeves 26*a*, 26*b* and is supported within the cavity 20 of the base 18*a*. In the present embodiment, interior walls 32 aid in supporting the EAS marker and also define the channels 21*a*, 21*b*. The cavity 20 and walls 32 are preferably dimensioned so that the EAS marker is approximately flush with the perimeter of the walls 19*b*–19*e*. Once the EAS marker is in position, the backing member 18*b* is secured to the base 18*a*. In this manner, the EAS marker is hidden within the housing and is not readily accessible to the consumer. The backing member may have any of a variety of forms, and is an adhesive-backed plastic sticker in the present embodiment.

Figure 5:
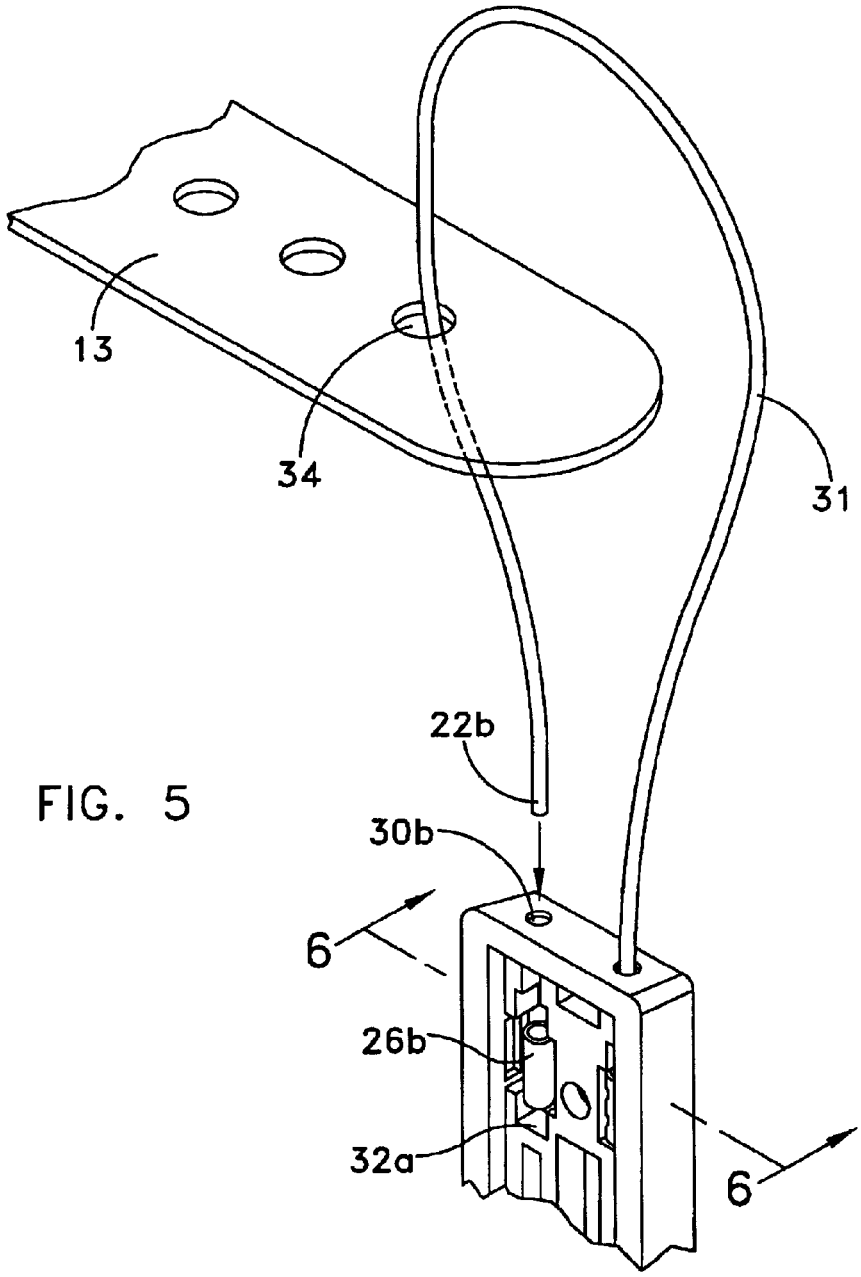
FIG. 5 is a perspective view of a top portion of the anti-theft tag of FIG. 4 during attachment.
Figure 6:
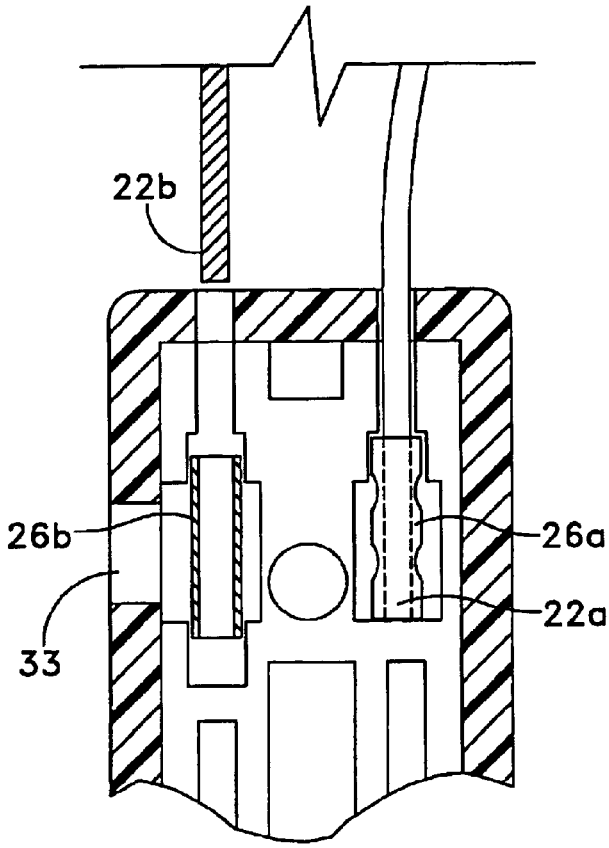
FIG. 6 is a cross sectional view taken along lines 6—6 of FIG. 5 prior to insertion of a second end of the wire into the housing.
Figure 7:
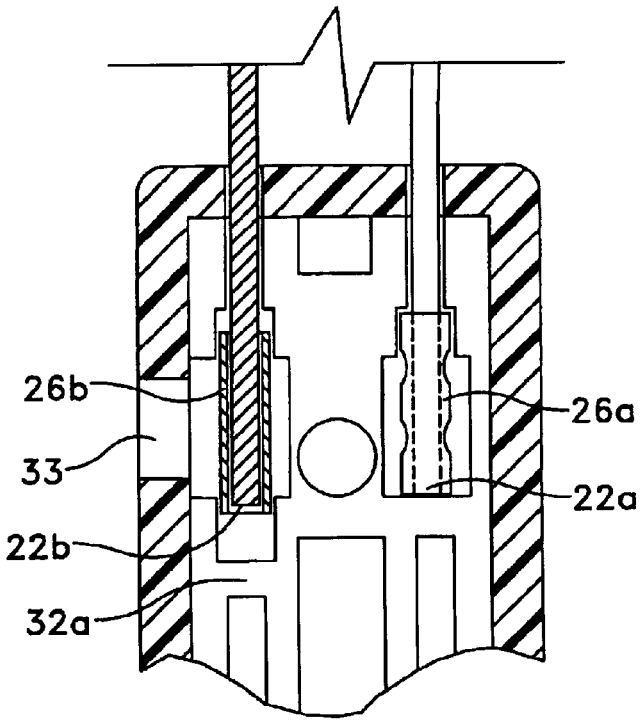
FIG. 7 is a is a cross sectional view taken along lines 6—6 of FIG. 5 after insertion of a second end of the wire into the housing.
Figure 8:
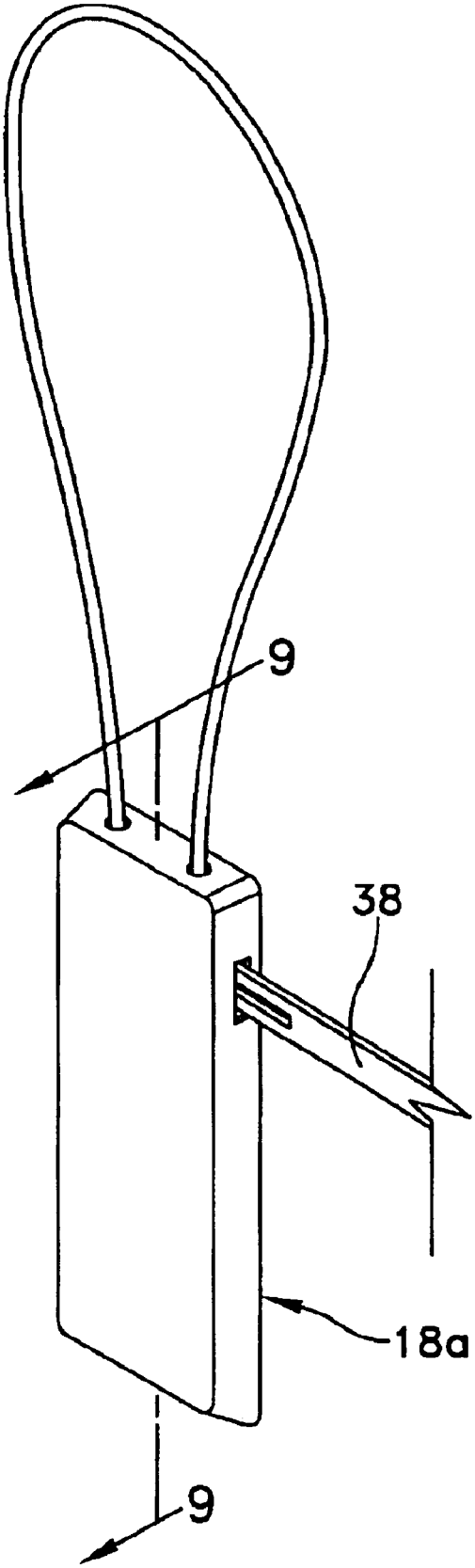
FIG. 8 is a perspective view of the anti-theft tag of FIG. 1 upon insertion of a crimping tool.
Figure 9:
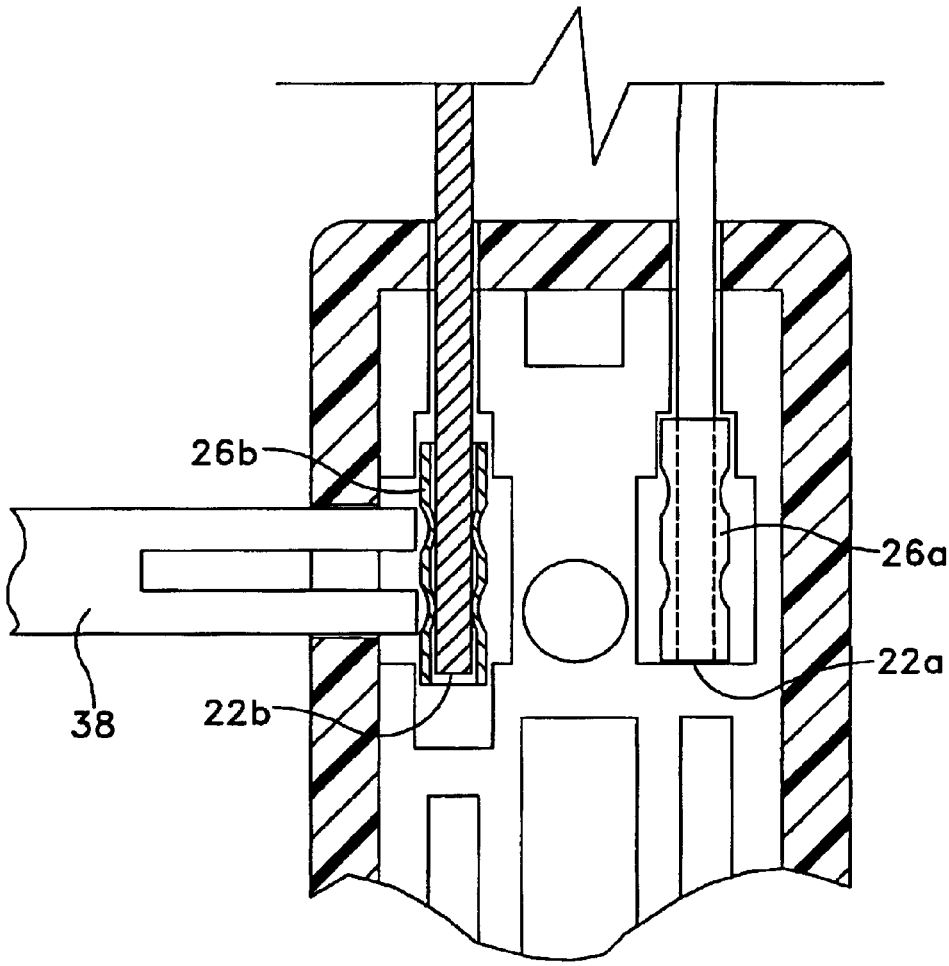
FIG. 9 is a cross sectional view taken along lines 9—9 of FIG. 8 illustrating crimping of the second end of the wire.
Figure 10:
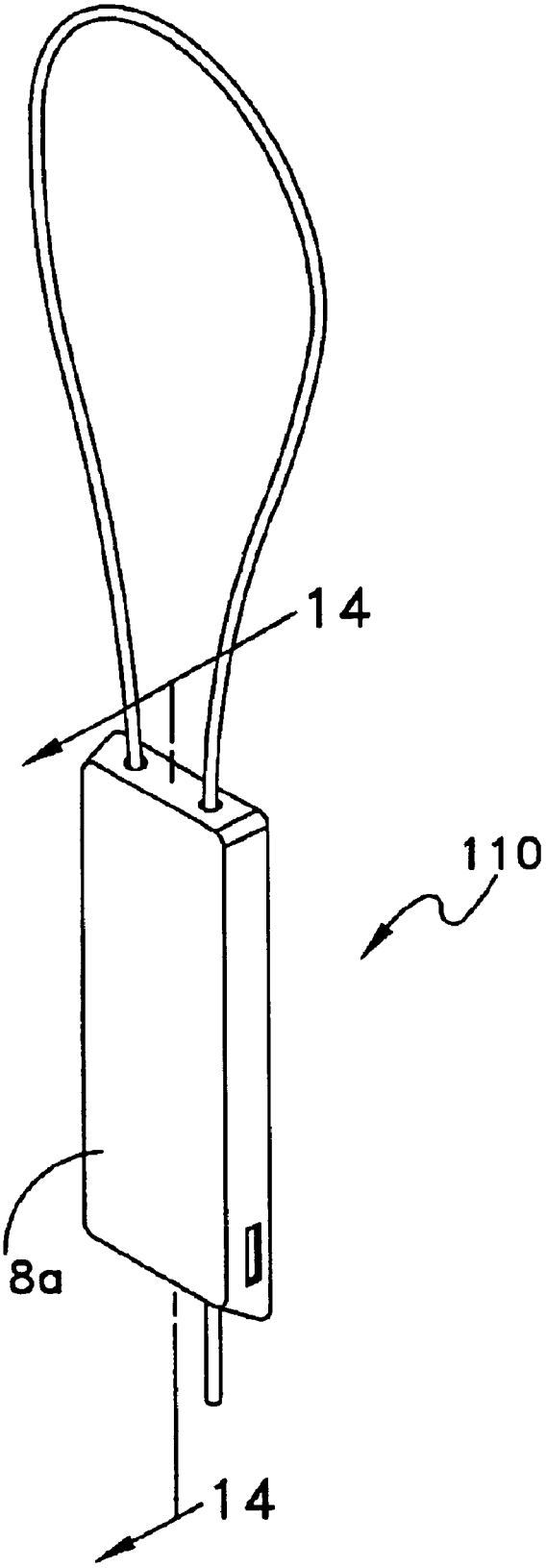
FIG. 10 is a front perspective view of an anti-theft tag in accordance with a second embodiment.
Figure 11:
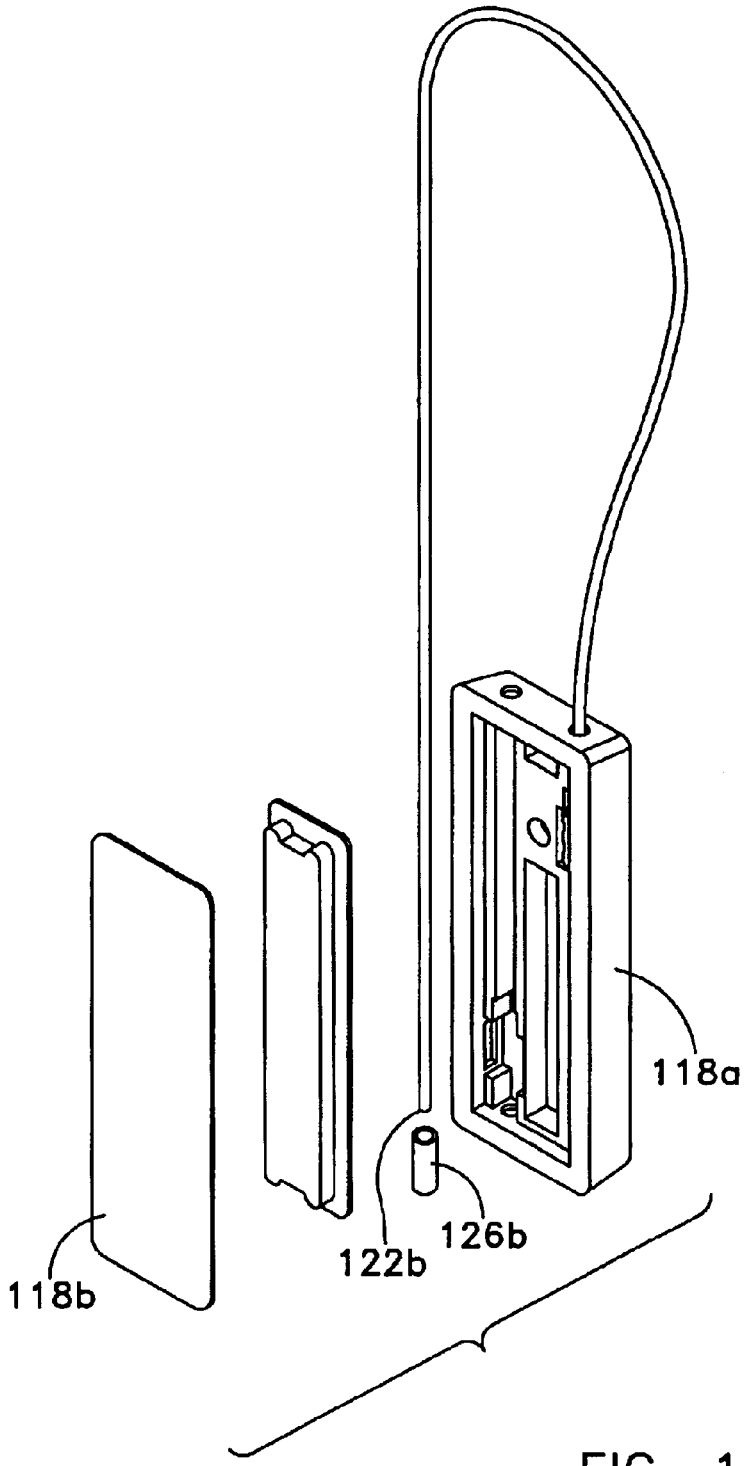
FIG. 11 is an exploded view of the anti-theft tag of FIG. 10.
Figure 12:
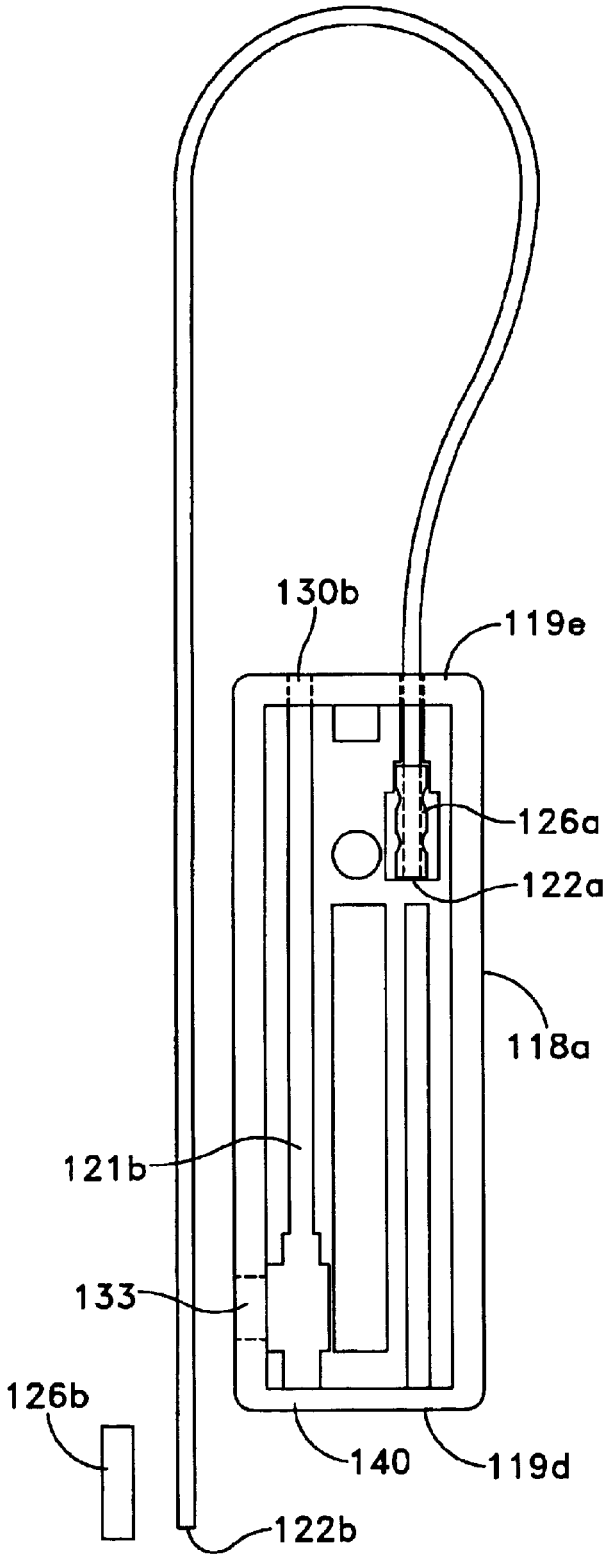
FIG. 12 is a top plan view of the anti-theft tag of FIG. 10 with the backing removed.

Referring now to FIGS. 5–9, connection of the tag to an article, such as a watch band 13 is illustrated. Although the backing member 18*b* is missing for purposes of illustration, in use the backing member would be in place. To attach the anti-theft security tag, the second end 22*b* is inserted about the article, here through a hole 34 in the watch band, and into opening 30*b* so as to form a loop 31 (FIGS. 5–6). The second end 22*b* is then inserted into crimping sleeve 26*b* disposed within channel 21*b* (FIG. 7). The crimping sleeve is in alignment with opening 30*b* so that the second end is easily received within the sleeve. In the present embodiment, a portion 32*a* of interior wall 32 prevents the second end 22*b* from being over-inserted and also aids in retaining the crimping sleeve. Slot 33 is sized to receive a crimping tool 38, and is disposed through side wall 19*b* in alignment with the side of the crimping sleeve 26*b*. After the second end 22*b* is inserted within the crimping sleeve 26, the crimping tool is inserted through the slot 33 and engages the sleeve 26*b* in order to force the sleeve inwardly so as to crimp it around the second end of the engagement member. Because the sleeve 26*b* is sized larger than the opening 30*b*, even in the crimped state, the second end 22*b* is secured within the housing. Once the second end is crimped within the housing, the size of loop 31 is fixed, and the anti-theft tag is securely attached to the article. It will be appreciated the anti-theft tag described herein is capable of being readily assembled, while being tamper resistant after assembly, and may be attached to any number of articles.

Referring now to FIGS. 10–15, an alternate embodiment including an adjustable engagement member is illustrated. In this embodiment, all parts which are the same, or similar to, corresponding parts in the embodiment of FIGS. 1–9 are noted with the same two last numbers, but preceded by the numeral "1". As illustrated, the anti-theft tag 110 is identical to tag 10 described above, with the exception of channel 121*b* and the addition of a third opening 140 disposed through bottom wall 119*d*. In this embodiment, channel 121*b* extends the length of the base 118*a*, from opening 130*b* in top wall 119*e* down to opening 140 in bottom wall 119*d*. In addition, crimping sleeve 126*b* may preferably be positioned adjacent the bottom wall 119*d*. Likewise, the slot 133 for receiving the crimping tool is also positioned adjacent the bottom wall 119*d*, in alignment with crimping sleeve

126*b*. The remaining elements of the anti-theft tag 110 are the same as in the preceding embodiment, including the positioning of the first end 122*a* and crimping sleeve 126*a* within the base 118*a*.

Figure 13:
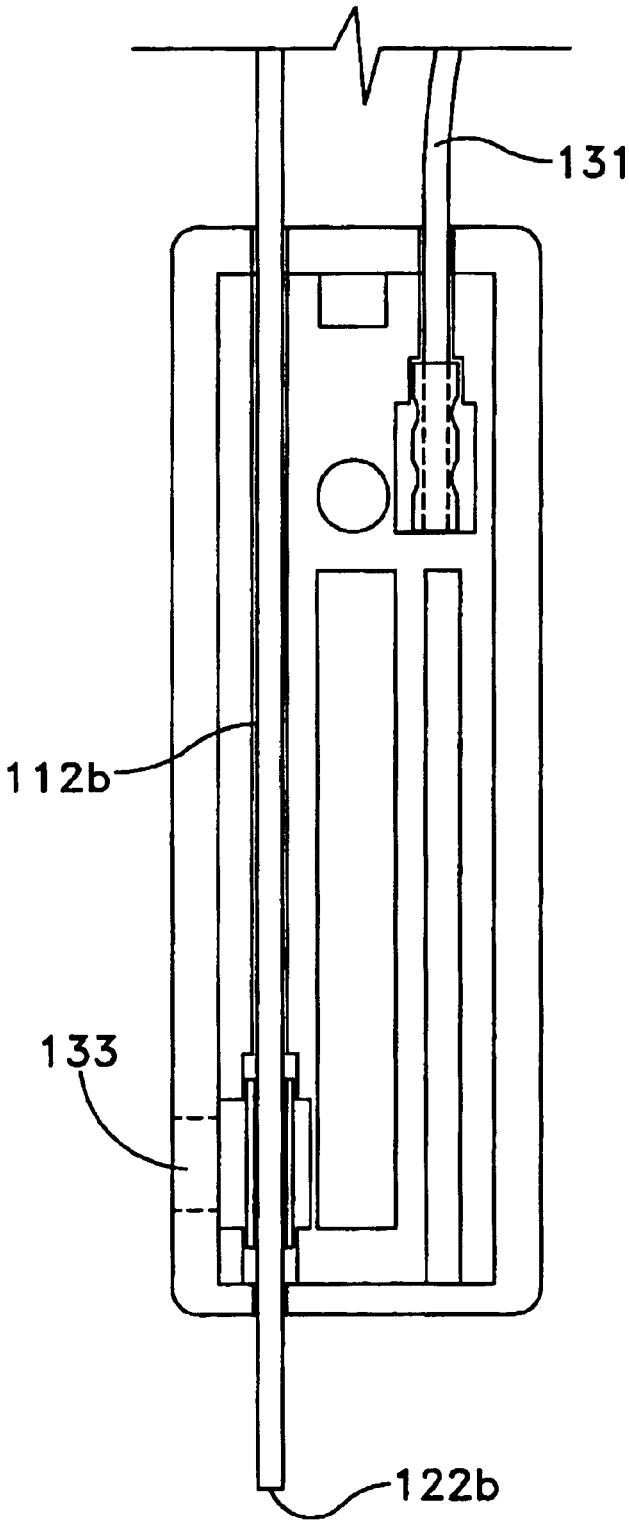
FIG. 13 is a top plan view of the anti-theft tag of FIG. 12 during insertion of a second end of the wire.
Figure 14:
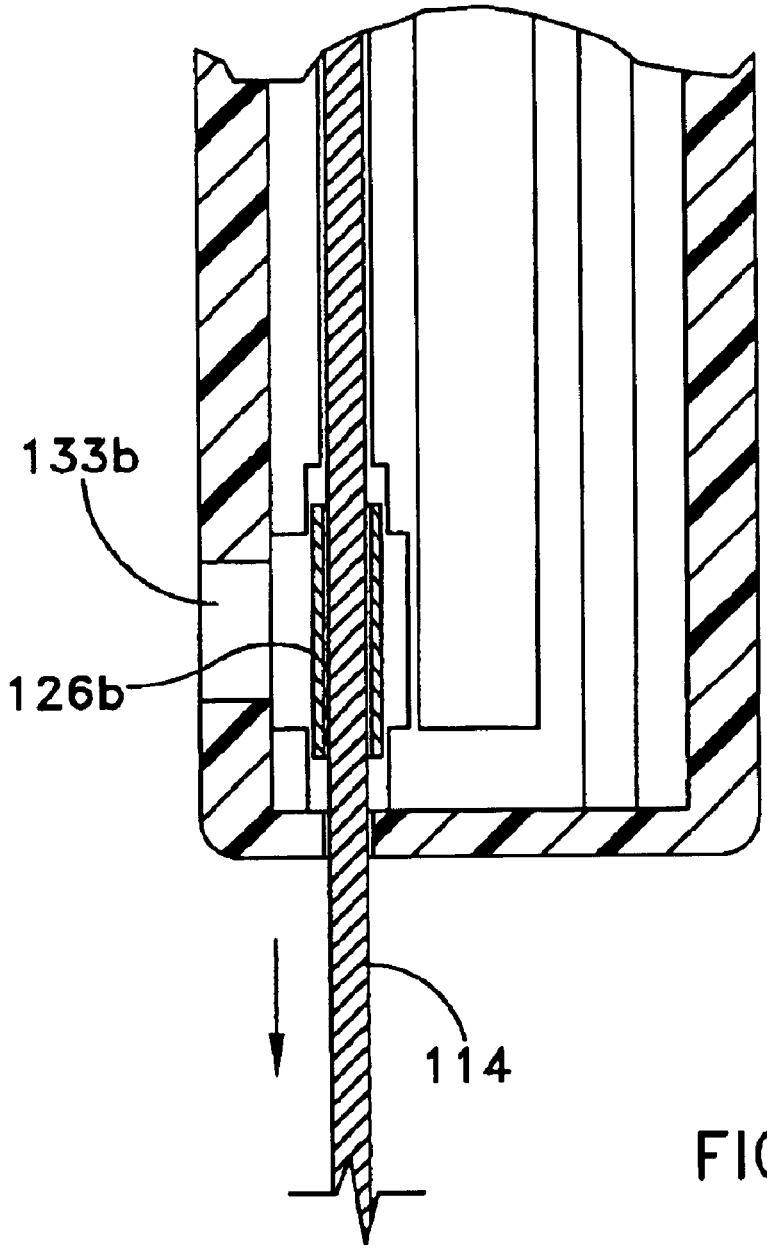
FIG. 14 is a cross sectional view taken along lines 14—14 of FIG. 13 during adjustment of the second end of the wire into the housing.
Figure 15:
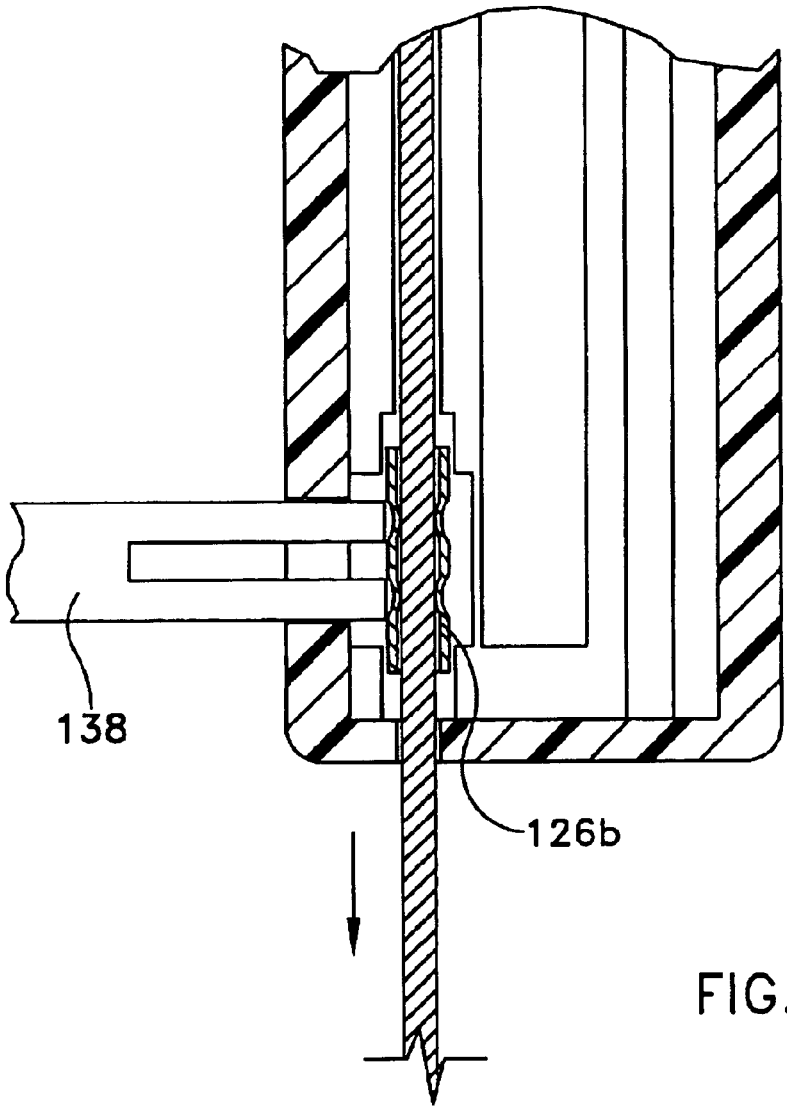
FIG. 15 is a cross sectional view upon insertion of a crimping tool illustrating crimping of the second end of the wire.

By extending the channel the length of the base 118*a*, from opening 130*b* in top wall 119*e* down to opening 140 in bottom wall 119*d* the second end 122*b* can pass entirely through the base and out of opening 140 in bottom wall 119*d* (FIG. 13). In this manner, the size of loop 131 is adjustable by increasing or decreasing the length of the wire which exits the housing through opening 140. In use, the first end is first crimped, the EAS marker 112 is inserted and the backing member 118*b* is attached, as described above with respect the first embodiment. The second end 122*b* is then passed through or around the article, through the first opening 130*b*, into channel 121*b*, through sleeve 126*b* and out of opening 140. The wire continues to be fed through the opening 140 until loop 131 reaches the desired size. The sleeve 126*b* is then crimped by applying the crimping tool 138 through slot 133, as described above to secure the tag and set the size of loop 131. After crimping, the portion of the wire which extends from opening 140 may be cut, if desired.

It will be appreciated the anti-theft tag described in this embodiment is capable of being readily adjusted to fit a variety of articles while being tamper resistant after assembly, and may be attached to any number of articles.

It will be understood that various modifications may be made to the embodiments disclosed herein. For example, it should be understood that the channels may or may not be provided, that the backing member may take any of a variety of forms and be attached to the base in any known manner, and the wire may be formed of alternate materials, for example plastic. Also, although shown as rectangular, the housing may be other shapes, for example circular, in which case there would be more or less walls, depending upon the particular shape, as would be known to those of skill in the art. Therefore, the above description should not be construed as limiting, but merely as exemplifications of a preferred embodiment. Those skilled in the art will envision other modifications within the scope, spirit and intent of the invention.

What is claimed is:

1. An anti-theft tag for attachment to an article, comprising:

an engagement member constructed and arranged to secure the tag to the article, the engagement member including a first end and a second end;

a housing including a base having at least one wall bounding a cavity, the cavity being sized to receive an electronic article surveillance sensor, the housing further including a backing member;

a slot disposed through the at least one wall and sized to receive a portion of a crimping tool;

a crimping sleeve adapted to receive the second end of the engagement member and supported within the cavity in alignment with the slot; and wherein upon insertion of the second end into the crimping sleeve the crimping tool is insertable through the slot so as to engage the crimping sleeve in order to secure the second end of the engagement member within the housing so as to form a loop.

2. The anti-theft tag of claim 1, further comprising another crimping sleeve disposed about the first end of the engagement member and supported within the cavity.

3. The anti-theft tag of claim 1, wherein the base includes at least one channel sized to receive the second end of the engagement member and the crimping sleeve.

4. The anti-theft tag of claim 3, wherein the at least one wall includes at least one hole sized to receive the second end of the engagement member, the at least one hole sized to provide access to the at least one channel.

5. The anti-theft tag of claim 3, wherein the at least one channel includes a first and a second channel, the first channel being sized to receive the first end of the engagement member and the second channel being sized to receive the second end of the engagement member.

6. The anti-theft tag of claim 3, wherein the at least one wall includes a front wall, a pair of side walls, a bottom wall and a top wall.

7. The anti-theft tag of claim 6, wherein the at least one channel extends from the top wall to the bottom wall and wherein the top wall includes a hole in communication with a first end of the at least one channel and sized to receive the second end of the engagement member, and wherein the bottom wall includes a hole in communication with a second end of the at least one channel and sized to receive the second end of the engagement member, such that the second end of the engagement member is insertable into the base through the first hole and exits the base through the second hole in order that the length of the loop may be selectively adjustable.

8. The anti-theft tag of claim 1, wherein the backing member is an adhesive backed sticker.

9. The anti-theft tag of claim 1, wherein the engagement member includes a wire.

10. An anti-theft tag for attachment to an article, comprising:

an engagement member constructed and arranged to secure the tag to the article, the engagement member including a first end and a second end;

a housing including a base having at least one wall bounding a cavity, the cavity being sized to receive an electronic article surveillance sensor, the housing further including a backing member;

at least one channel disposed within the housing and sized to receive the second end of the engagement member;

a slot disposed through the at least one wall, in communication with the at least one channel, and sized to receive a portion of a crimping tool;

a first crimping sleeve disposed about the first end of the engagement member;

a second crimping sleeve adapted to receive the second end of the engagement member and supported within the at least one channel in alignment with the slot; and wherein upon insertion of the second end into the crimping sleeve the crimping tool is insertable through the slot so as to engage the crimping sleeve in order to secure the second end of the engagement member within the housing so as to form a loop.

11. The anti-theft tag of claim 10, wherein the at least one wall includes at least one hole sized to receive the second end of the engagement member, the at least one hole sized to provide access to the at least one channel.

12. The anti-theft tag of claim 10, wherein the at least one channel includes a first and a second channel, the first channel being sized to receive the first end of the engagement member and the second end being sized to receive the second end of the engagement member.

13. The anti-theft tag of claim 10, wherein the at least one wall includes a front wall, a pair of side walls, a bottom wall and a top wall.

14. The anti-theft tag of claim 13, wherein the at least one channel extends from the top wall to the bottom wall and wherein the top wall includes a hole in communication with a first end of the at least one channel and sized to receive the second end of the engagement member, and wherein the bottom wall includes a hole in communication with a second end of the at least one channel and sized to receive the second end of the engagement member, such that the second end of the engagement member is insertable into the base through the first hole and exits the base through the second hole in order that the length of the loop may be selectively adjustable.

15. The anti-theft tag of claim 10, wherein the backing member is an adhesive backed sticker.

16. A method of attaching an anti-theft tag to an article comprising the steps of:

providing an engagement member constructed and arranged to secure the tag to the article, the engagement member including a first end and a second end;

providing a housing including a base having at least one wall bounding a cavity, the cavity being sized to receive an electronic article surveillance sensor, the housing further including a backing member;

securing the first end of the engagement member to the housing;

providing a slot in the at least one wall sized to receive at least a portion of a crimping tool;

supporting a crimping sleeve within the housing in alignment with the slot disposed through the at least one wall.

17. The method of claim 16, further comprising the steps of:

inserting the second end of the engagement member into the crimping sleeve;

inserting a crimping tool through the slot and into engagement with the crimping sleeve;

crimping the sleeve about the second end of the engagement member so as to form a loop and secure the second end of the engagement member to the housing.

18. The method of claim 16, further comprising the steps of:

providing a first and a second hole in the at least one wall;

inserting the second end of the engagement member through the first hole and into the base;

inserting the second end of the engagement member through the second hole so that a length of the engagement member exits the base;

selectively adjusting the length of the engagement member exiting the base so as to adjust the size of the loop for engagement with the article.

19. The method of claim 18, further comprising the step of cutting the length of the engagement member exiting the base so that it is substantially flush with the at least one wall.

20. The method of claim 16, further comprising the step of supporting an electronic article surveillance sensor within the base.

* * * * *

UNITED STATES PATENT AND TRADEMARK OFFICE

CERTIFICATE OF CORRECTION

PATENT NO. : 6,933,847 B2
APPLICATION NO. : 10/696483
DATED : August 23, 2005
INVENTOR(S) : Jeffrey A. Feibelman It is certified that error appears in the above-identified patent and that said Letters Patent is hereby corrected as shown below:

On the Title page, Box [73] Assignee, delete "A&H Manufacturing, Co." and replace it with --Display Technologies, Inc.--

Signed and Sealed this

Ninth Day of January, 2007

JON W. DUDAS
*Director of the United States Patent and Trademark Office*